United States Patent [19]

Naeve

[11] 4,309,835

[45] Jan. 12, 1982

[54] FOLDABLE FRAME STRUCTURE

[76] Inventor: Don A. Naeve, 651 Cambridge Dr., Richardson, Tex. 75080

[21] Appl. No.: 106,942

[22] Filed: Dec. 26, 1979

Related U.S. Application Data

[63] Continuation-in-part of Ser. No. 63,974, Aug. 6, 1979, abandoned.

[51] Int. Cl.[3] ..... G09F 3/00

[52] U.S. Cl. ..... 40/310; 40/124.1; 40/155; 40/539; 229/92.1

[58] Field of Search ..... 40/124.1, 152.1, 155, 40/156, 158 R, 539, 310; 229/92.1, 92.3, 92.5

[56] References Cited

U.S. PATENT DOCUMENTS

| | | | |
|---|---|---|---|
| 1,853,622 | 4/1932 | Kennedy | 40/310 |
| 1,891,353 | 12/1932 | Koehrman | 40/310 |
| 2,303,328 | 1/1942 | Cross | 40/152.1 |
| 2,504,277 | 4/1950 | Otterson | 40/152.1 |
| 2,512,957 | 6/1950 | McCargo | 40/152.1 X |
| 2,731,748 | 1/1956 | Polay | 40/539 X |
| 2,814,896 | 12/1957 | Fujikawa | 40/155 |
| 3,174,244 | 3/1965 | Walton | 40/158 R |
| 4,055,690 | 10/1977 | Patterson | 40/124.1 X |
| 4,084,015 | 4/1978 | Patterson | 40/539 X |
| 4,186,868 | 2/1980 | Coleman | 40/156 X |

*Primary Examiner*—Gene Mancene
*Assistant Examiner*—G. Lee Skillington
*Attorney, Agent, or Firm*—Richards, Harris & Medlock

[57] ABSTRACT

A product premium (20) includes a foldable frame (22) having a four-sided base (36) with a wall portion (80, 82, 84, 86) extending from each side of the base. An extension (24, 26, 28, 30) is detachably secured to the end of each wall portion along the edge of the wall portion remote from the attachment of the wall portion to the base. The extension and wall portion are substantially equal in dimension to the base (36) such that each extension and wall portion may be folded to substantially overlie the base with the extensions providing area (115, 150, 182, 230, 292) for promotional information thereon.

7 Claims, 17 Drawing Figures

FOLDABLE FRAME STRUCTURE

CROSS REFERENCE TO RELATED APPLICATION

This application is a continuous-in-part of application Ser. No. 06/063,974 filed Aug. 6, 1979 now abandoned, by the present applicant and entitled "FOLDABLE FRAME STRUCTURE", now abandoned.

TECHNICAL FIELD

The present invention relates to a foldable frame structure, and more particularly, to such a structure having removable sections on which promotional information may be applied.

BACKGROUND ART

Promotional devices are used regularly as an incentive to a prospective buyer to purchase particular products. In particular, promotional devices have been used for some time as both in-package premiums, such as the premiums contained within breakfast cereals and the like, as well as premiums which are attached exteriorly to the food or beverage container. These premiums vary from trading cards, which are directed to influencing the younger purchaser, to holiday greeting cards, directed to influencing older purchasers.

In certain cases, advertisement for the product is also included on the premium item. However, where the premium item is one which may be displayed or used, such as a trading card or a holiday greeting card, the premium is more valuable to the consumer if the advertisement is so positioned that it may be removed or is obscured when the premium is actually displayed or used. Thus, it has been the practice to include advertisement on a portion of the premium package where it does not overlie or interfere with the premium item itself.

A need has arisen for a unique premium item which may be attached to food containers, or inserted therein, having ample room for advertisements and designed in such a way that the advertisements do not conflict with the design and appearance of the premium.

DISCLOSURE OF INVENTION

The present invention provides an improved product premium which may be incorporated in any type of product premium including those for attachment to or insertion within a container. While the present invention provides ample space for promotional information, the premium is so designed that the portion of the premium containing the promotional information may be readily removed from the premium itself prior to actual use and assembly of the premium.

The present invention is directed to a premium which may be assembled as a frame structure bearing a pictorial illustration thereon. The premium includes a rectangular base having a border along the outer edges thereof encircling a pictorial illustration. A wall portion is attached along each side of the base and is foldable along its line of attachment to the base for attachment thereto. When attached to the base, the wall portions form a three-dimensional frame surrounding the pictorial illustration.

An extension is detachably secured to the end of each wall portion along its edge remote from the attachment of the wall portion to the base. The extension and wall portion, prior to detachment of the extension, are substantially equal in dimension to the base such that each extension and wall portion may be folded to substantially overlie the base. With each extension and wall portion folded over the base, a substantially planar card-like premium, having the dimensions of the base of the frame, is formed.

The outermost extension and wall portion are formed with an attachment structure for securing the premium to any desired product. In accordance with one embodiment of the invention, such attachment structure includes a flap attached to one of the extensions and having an aperture therethrough for engagement over the neck of a bottle. In this way, the entire premium may be attached to beverage containers by merely engaging this flap attachment over the neck of the container.

The extension portions of the premium provide ample space for appropriate promotional information such that information may be applied to the premium for display of any desired advertising message. Further, the extensions complete the wall portions of the foldable frame to form a compact and fully protected premium package. In particular, these extensions fully protect the pictorial area on the base so that the design cannot be marred or damaged prior to actual use of the premium by the purchaser.

The extensions are detachable from the frame wall portions. This may be facilitated by providing perforations along the boundary between the extensions and the frame wall portions. In this way, the purchaser may simply remove the extensions, thereby removing the advertisements attached thereto prior to assembly of the foldable frame for display of the pictorial illustration on the base thereof.

In accordance with an alternative embodiment of the invention, an extension is attached to only one of the wall portions. In this embodiment, the need for extensions for attachment to each of the wall portions is eliminated while providing necessary structure for maintaining the frame in a folded configuration with each of the wall portions substantially flat against the base of the frame. This position is used in shipping and handling the frames prior to their assembly. In accordance with this embodiment of the invention, the three wall portions not containing an extension are folded along their line of connection to the base in a position substantially flatly overlying the base. The wall portion containing the extension is then folded thereover and is joined by glue, cement or other attachment means to an underlying wall portion at a point where the attachment will not be visible when the frame is assembled. Thus, the frame may be easily held in its folded position without requiring attachment at any point on the frame which would be visible upon assembly. Further, the pictorial area is protected in this folded position.

In accordance with another embodiment of the invention, the foldable frame serves as the cover for a magazine or book.

Thus, the present invention provides a product premium which may be incorporated in any type of product premium including those for attachment to a beverage or other container. The premium has removable extensions attached to the wall portions of the foldable frame. These extensions provide ample space for advertisement while permitting their removal prior to assembly of the foldable frame.

BRIEF DESCRIPTION OF THE DRAWINGS

For a more complete understanding of the present invention, and for further details and advantages thereof, reference is now made to the following description taken in conjunction with the accompanying drawings, in which.

DETAILED DESCRIPTION

Figure 1:
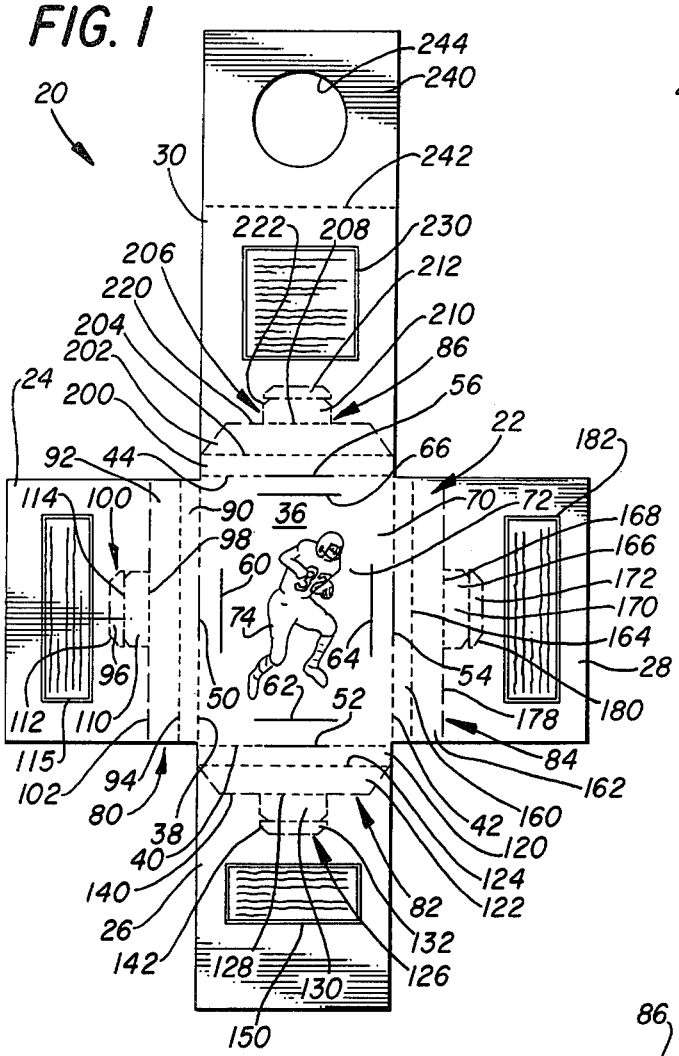
FIG. 1 illustrates a plan view of the present invention in its unfolded configuration.

FIG. 1 illustrates the premium 20 of the present invention in its unfolded position. Premium 20 includes a foldable frame 22 having extensions 24, 26, 28 and 30 extending from foldable frame 22 as will be discussed hereinafter in greater detail. Foldable frame 22 includes a base 36 defined by fold lines 38, 40, 42 and 44. Slots 50, 52, 54 and 56 are cut through foldable frame 22 on fold lines 38, 40, 42 and 44, respectively, and substantially intermediate of the ends of the lines. Slots 60, 62, 64 and 66 are also formed within base 36, parallel to slots 50, 52, 54 and 56, respectively, but spaced inwardly therefrom. In an alternative embodiment of the present invention, slots 50, 52, 54 and 56 are formed in base 36 intermediate of fold lines 38, 40, 42 and 44 and slots 60, 62, 64 and 66, respectively. Base 36 includes a border area 70 defined around the periphery of base 36 and between fold lines 38, 40, 42 and 44 and lines drawn through slots 60, 62, 64 and 66. Base 36 further includes a pictorial area 72. As is shown in FIG. 1, an illustration 74 is generally depicted on pictorial area 72. Illustration 74 may be any desired illustration appropriate to the age group to which the premium is directed.

Frame 22 further includes wall portions 80, 82, 84 and 86. Wall portion 80 includes an outer frame wall 90 and an inner frame wall 92 separated by a fold line 94. Wall portion 80 further includes a tab 96 joined to inner wall 92 along a fold line 98. Tab 96 includes an engaging tab 110 and a locking tab 112 joined to engaging tab 110 along fold line 114. Extension 24 is joined to wall portion 80 along perforated lines 100 and 102.

As is illustrated in FIG. 1, extension 24 has an area 115 for receiving promotion information and the like. Wall portions 82, 84 and 86 are similar in arrangement and construction to wall portion 80 and are attached to base 36 along fold lines 40, 42 and 44, respectively. Wall portion 82 includes an outer wall 120 and an inner wall 122 separated by a fold line 124. A tab 126 is attached from inner wall 122 along fold line 128 and includes an engaging tab 130 and a locking tab 132. Extension 26 is joined to wall portion 82 along perforation lines 140 and 142. Extension 26 includes an area 150 for receiving promotional information thereon.

Wall portion 84 includes an outer wall 160 and an inner wall 162 separated by fold line 164. A tab 166 is joined to inner wall 162 along fold line 168 and includes an engaging tab 170 and a locking tab 172. Extension 28 is connected to wall portion 84 along perforated lines 178 and 180. Extension 28 includes an area 182 for receiving promotional information thereon.

Wall portion 86 includes an outer wall 200 and an inner wall 202 connected to outer wall 200 along a fold line 204. A tab 206 is joined to inner wall 202 along fold line 208 and includes an engaging tab 210 and a locking tab 212. Extension 30 is connected to wall locking tab 212. Extension 30 is connected to wall portion 86 along perforated lines 220 and 222. Extension 30 includes an area 230 for receiving promotional information thereon. The edge of extension 30 opposite frame 22 has an attachment piece 240 connected thereto along fold line 242. In the illustrated embodiment of the invention, attachment piece 240 has an aperture 244 formed therein for receiving the neck of a bottle. It will, of course, be understood that the present invention envisions the use of attachment piece 240 to act as an attachment means for attaching the premium to any type of package or product as desired. For example, attachment piece 240 may be attached to a package of snack foods by attachment of piece 240 within the package seal.

Referring to FIG. 1, it will now be appreciated that wall portion 80 and extension 24 together define an area substantially equal to the area of base 36. Likewise, wall portion 82 with extension 26 define an area substantially equal to base 36. In the same way, wall portion 84 with extension 28 and wall portion 86 with extension 30 define areas substantially equal to the area of base 36.

Figure 2:
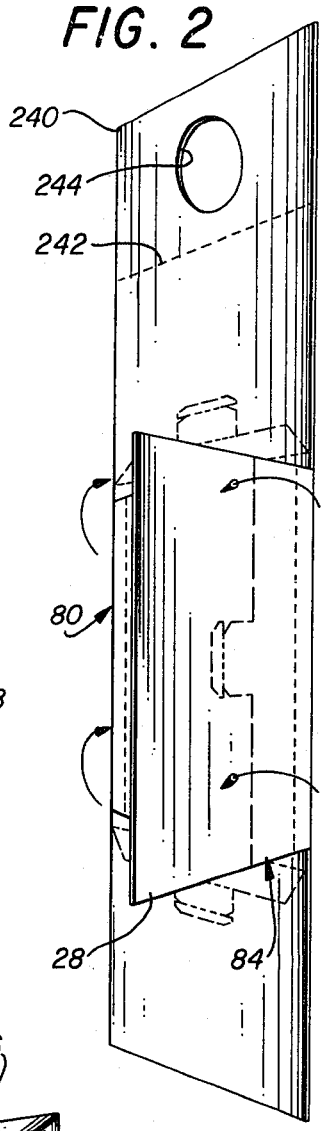
FIG. 2 illustrates a perspective view of the present invention showing the invention partially folded.
Figure 3:
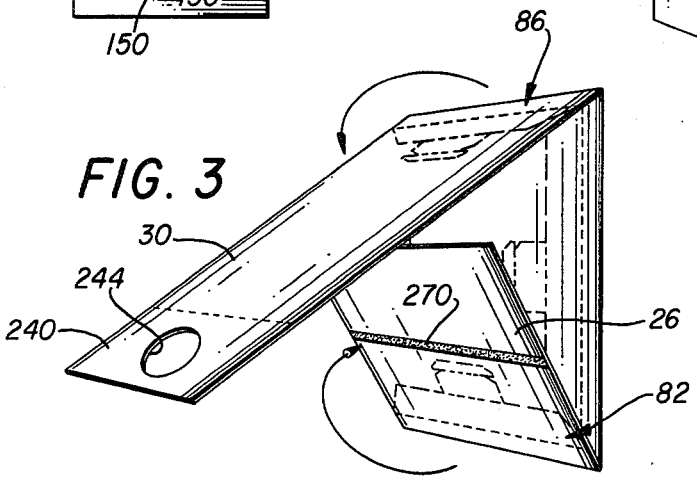
FIG. 3 illustrates the present invention in a further state of being folded.

As a result of this arrangement, it may be seen that premium 20 may be folded to define a very compact package. FIG. 2 shows the premium of the present invention being folded. In FIG. 2, wall portion 80 and extension 24 are folded along fold line 38 onto base 36 and wall portion 84 and extension 28 are in the process of being folded along fold line 42 to overlie wall portion 80 and extension 24. In FIG. 3, wall portion 82 and extension 26 are in the process of being folded to overlie wall portion 84 and extension 28 with wall portion 86 and extension 30 being folded to overlie wall portion 84 and extension 26.

Referring to FIG. 3, an appropriate glue or cement 270 is attached to extension 26 for engagement with extension 30 to hold the premium package of the present invention in a folded position prior to actual use. As is also shown in FIGS. 2 and 3, each of the extensions 24, 26, 28 and 30 provides ample area on their face opposite those shown in FIG. 1 for displaying advertisement or promotional information as desired.

Figure 4:
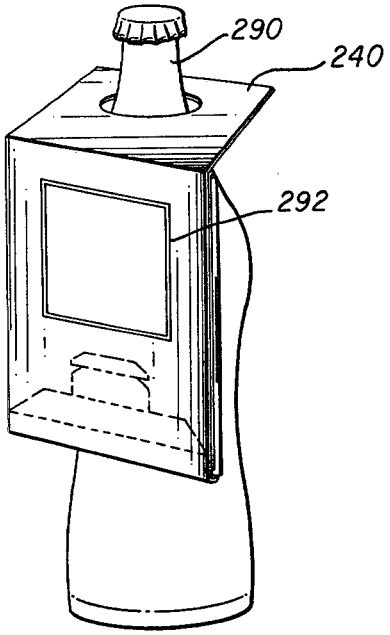
FIG. 4 illustrates the present invention in a completely folded configuration and attached to a beverage bottle.

Referring now to FIG. 4, the present invention is shown in its completely folded position with attachment piece 240 engaged over a beverage bottle 290. As is also shown in FIG. 4, extension 30 and wall portion 86 are exposed to view with the premium package attached to bottle 290 and extension 30 displays an area 292 on which appropriate advertising may be placed. Likewise, appropriate advertising may be placed on attachment piece 240.

Figure 5:
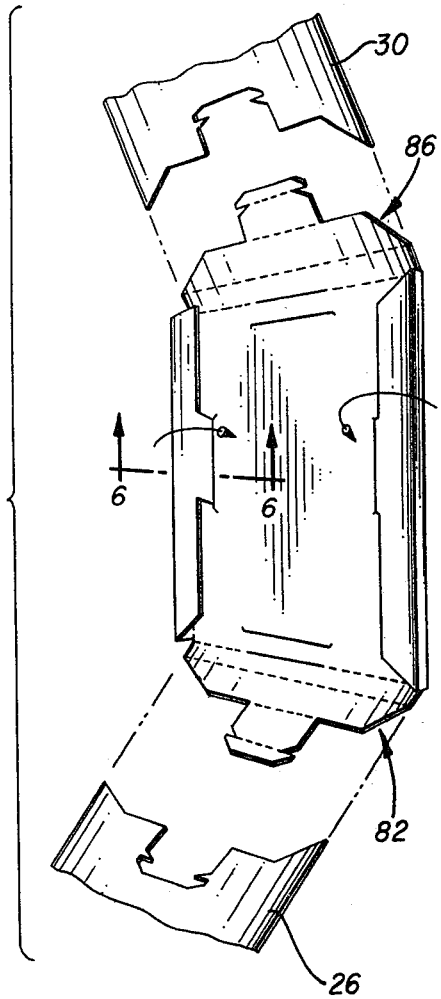
FIG. 5 illustrates the present invention with the extensions removed and the foldable frame partially assembled.

FIG. 5 illustrates use of the present invention by the purchaser. In use, the premium is removed from the beverage bottle by removal from the neck of the beverage container. The premium is unfolded to assume the position illustrated in FIG. 1. Thereafter, each of extensions 24, 26, 28 and 30 is removed from wall portions 80, 82, 84 and 86, respectively. This is accomplished by merely breaking away the extensions along the perforated lines defining the boundaries between the extensions and the wall portions. For example, with respect to extension 24 and wall portion 80, extension 24 is broken away from wall portion 80 along perforated lines 100 and 102. Similarly, extensions 26, 28 and 30 are removed from wall portions 82, 84 and 86, respectively, of frame 22. It should be noticed that by removing extensions 24, 26, 28 and 30, all of the advertising material thereon is removed from the frame by the consumer. Thus, the frame, when completely assembled, has a finished appearance and is significantly more valuable to the purchaser. However, the frame provides ample advertising space for the manufacturer prior to the actual end use of the premium as a frame.

Figure 6:
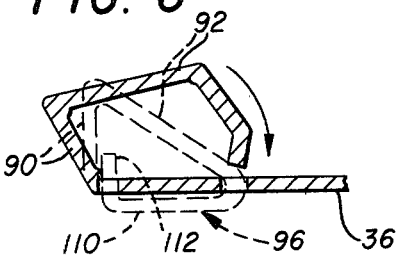
FIG. 6 is a section view taken along line 6—6 of FIG. 5.

Referring to FIG. 5, it is seen that extensions 24 and 28 have been removed and extensions 26 and 30, also removed, are shown being pulled away from wall portions 82 and 86. Also shown in FIG. 5 are the beginning steps in assembly of frame 22. Referring to both FIGS. 5 and 6, this is accomplished by folding the wall portions such that the outer walls of the wall portions assume a position substantially perpendicular to base 36, with the inner wall of the wall portions substantially inclined relative to base 36 with the engaging tabs and locking tabs engaged through base 36. Referring to FIG. 6, outer wall 90 is folded along fold line 38 to assume a substantially vertical position with inner wall 92 folded relative to outer wall 90 along fold line 94. Tab 96 is engaged through slot 60 with tab 110 being positioned below base 36 and locking tab 112 being engaged upwardly through slot 50 in base 36. In this way, each of wall portions 80, 82, 84 and 86 is folded to complete the frame as illustrated in FIGS. 7 and 8.

Figure 7:
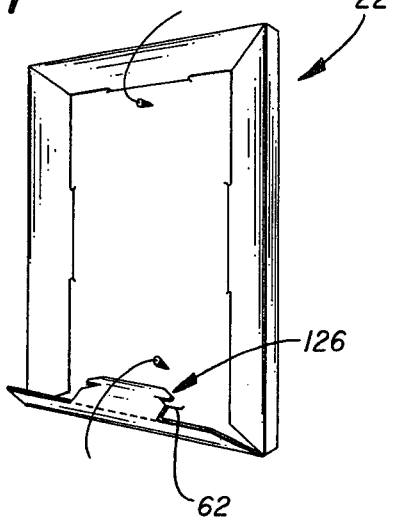
FIG. 7 illustrates the present invention with the extensions removed and the foldable frame in the process of being assembled.

FIG. 7 shows wall portions 80, 84 and 86 completely folded and engaged to base 36 with wall portion 82 in the process of being completed and positioned in place. FIG. 7 illustrates tab 126 about to be engaged into slot 62 to complete the frame as shown in FIG. 8.

Figure 8:
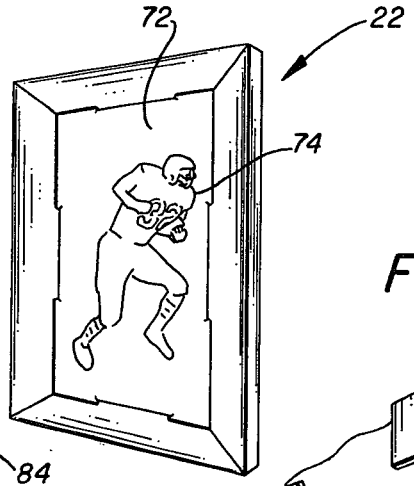
FIG. 8 illustrates the present invention with the extensions removed and the foldable frame completely assembled.

Referring to FIG. 8, it will be seen that the completed structure provides a three-dimensional frame structure consisting of wall portions 80, 82, 84 and 86 folded and securely locked to base 36. These wall portions, in their folded position, surround the illustration 74 depicted in the pictorial area 72 to highlight the illustration. It will be appreciated that the advertisements readily viewable by a customer on extensions 24, 26, 28 and 30 prior to assembly to the frame are removed so as not to interfere with the completed frame construction.

Figure 9:
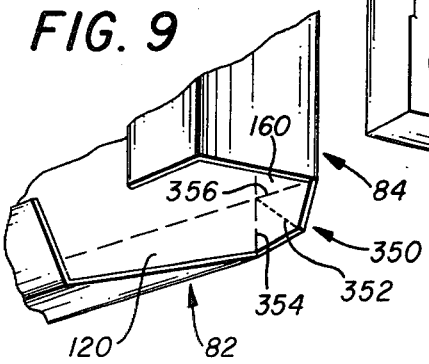
FIG. 9 illustrates an alternative embodiment of the present invention incorporating a corner tab and showing the frame in a partially folded position.

FIG. 9 illustrates an alternative embodiment of the present invention wherein a corner tab 350 is joined between outer wall 120 of wall portion 82 and outer wall 160 of wall portion 84. With foldable frame 22 in its unfolded position, tab 350 is in the plane of frame 22. Tab 350 has a fold line 352 extending outwardly from base 36 of foldable frame 22 and fold lines 354 and 356 along the lines of attachment of the tab to outer walls 120 and 160, respectively.

Figure 10:
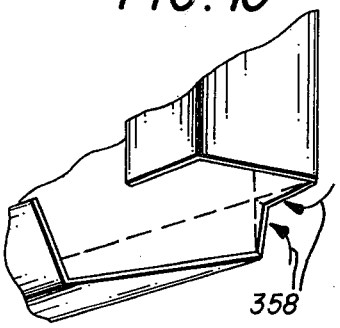
FIG. 10 illustrates the alternative embodiment illustrated in FIG. 9 with the tab shown in a partially folded position.
Figure 11:
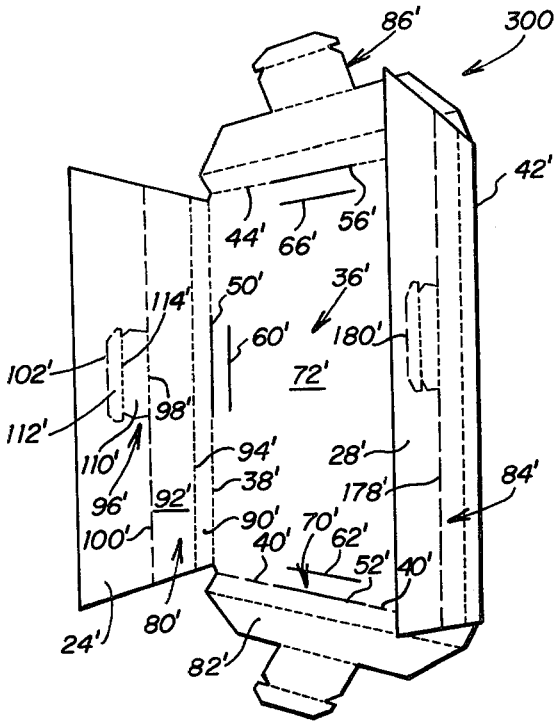
FIG. 11 illustrates a perspective view of an alternative embodiment of the present invention showing the invention partially folded.

Referring to FIG. 10, as frame 22 is assembled, tab 350 is folded inwardly in the direction illustrated by arrows 358 to assume a position underlying outer wall 120 and inner wall 122 and outer wall 160 and inner wall 162 of wall portions 82 and 84. The use of tabs 350 is optional in the practice of the present invention although the use of such tabs produces a finished corner with the frame assembled leaving no exposed edge along outer walls 120 and 160.

Although FIGS. 9 and 10 illustrate a tab 360 between outer walls 120 and 160, it will be understood that such a tab may also be included between outer walls 160 and 200, between outer walls 200 and 90 and between outer walls 90 and 120 such that tabs will be positioned at each of the corners of foldable frame 22.

Thus, the present invention provides a premium which may be readily folded into a very flat package and easily secured to a beverage or other container and having ample room for appropriate promotional information and advertising thereon. However, the premium of the present invention also provides for ready removal of the extension portions having the advertising thereon so that the completed frame does not display the advertising material.

It will be clearly understood that the present invention may be readily used as a premium within packages or otherwise attached to the exterior of packages without the use of attachment piece 240. The structure may be manufactured with attachment piece 240 completely deleted from the structure. In this embodiment, it will be appreciated that the present invention still provides ample extension portions having advertising space thereon. As in the embodiment illustrated in FIGS. 1–4, each of the portions of the structure overlying base 36 when the structure is in its folded position is designed to substantially correspond in area to the base structure. In this way, a very uniform folded structure is produced, making the maximum use of this extra material by permitting advertising thereon while providing a unique premium which may be constructed after removal of those portions of the structure. Thus, the present invention will clearly be understood to cover the above-described premium structure whether including the attachment piece 240 or produced without it.

FIGS. 11–14 illustrate a foldable frame 300 substantially similar to frame 22 illustrated in FIGS. 1–10. Because the components of frame 300 are in a large part identical or similar to those in the embodiment illustrated in FIGS. 1–10, corresponding or like components are designated with the same numeral as those identified with respect to frame 22 with the addition of the designation prime (') added thereto.

Referring to FIGS. 11–14, it will be appreciated that frame 300 includes a base 36' defined by score lines 38', 40', 42' and 44'. Slots 50', 52' and 56' are cut through foldable frame 22 on score lines 38', 40' and 44', respectively, and substantially intermediate of the ends of the lines. A similar slot is also cut along score line 42'. Slots 60', 62' and 66' are also formed within base 36', parallel to slots 50', 52' and 56', respectively, but spaced inwardly therefrom. A similar slot is formed parallel to the slot on score line 42', but is not illustrated for purposes of clarity.

Base 36' includes a border area 70' defined around the periphery of base 36' and between score lines 38', 40' and 44' and lines drawn through slots 60', 62' and 66'. Base 36' further includes a pictorial area 72'.

Frame 300 further includes wall portions 80', 82', 84' and 86'. Wall portion 80' includes an outer frame wall 90' and an inner frame wall 92' separated by fold line 94'. Wall portion 80' further includes a tab 96' joined to inner wall 92' along fold line 98'. Tab 96' includes an engaging tab 110' and a locking tab 112' joined to engaging tab 110' along fold line 114'. An extension 24' is joined to wall portion 80' along perforated lines 100' and 102'.

Wall portions 82', 84' and 86' are similar in arrangement and construction to wall portion 80' and are attached to base 36' along score lines 40', 42' and 44', respectively. Wall portion 84' includes an extension 28' joined to wall portion 84' along perforated lines 178' and 180'. In contrast to the embodiments illustrated in FIGS. 1–10, no extensions are attached to wall portions 82' or 86'.

Figure 12:
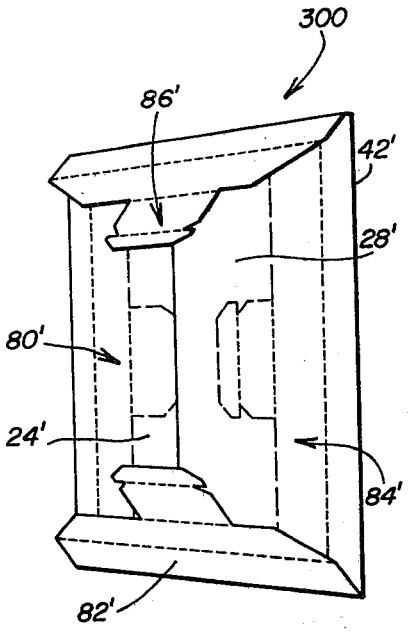
FIG. 12 illustrates a perspective view showing the embodiment of FIG. 11 in a further state of being folded.

FIG. 12 illustrates one manner in folding frame 300 for shipping or insertion either into or on a product or package. Referring to FIG. 12, wall portion 80' and extension 24' are folded inwardly along score line 38' such that the wall portion and extension overlie base 36'. While the combined wall portion 80' and extension 24' may be substantially equal in dimension to base 36', in the illustrated embodiment of the invention, wall portion 80' and extension 24' are substantially equal to the height of base 36' but substantially shorter in width.

Subsequent to folding of wall portion 80' and extension 24' onto base 36', wall portion 84' and extension 28' are folded along score line 42' to overlie wall portion 80' and extension 24' as illustrated. As can be seen in FIG. 12, wall portion 84' and extension 28' may be secured to wall portion 80' and extension 24' by applying a small amount of glue or cement between extension 28' and extension 24'. In this way, these two portions of frame 300 may be secured in their positions substantially planar to base 36' without requiring attachment to the pictorial area 72'. Thus, the possibility of damaging the pictorial area is avoided.

Referring still to FIG. 12, wall portions 82' and 86' are then folded inwardly along score lines 40' and 44', respectively, to overlie wall portion 84' and extension 28'. Again, these wall portions may be secured to the material underlying them by applying a small amount of glue or cement between the underside of wall portions 82' and 86' and either extension 28' or extension 24'. Because the attachment surface of wall portions 82' and 86' is a surface which is not exposed to view in the completed frame, this attachment does not present the possibility of damaging a portion of the frame which may be viewed when assembled. It will be understood that frame 300 may be retained in the folded position according to the folding method of FIGS. 11 and 12 by only attaching wall portions 82' and 86' to the extensions 24' or 28' therebelow. This approach would eliminate the need for attaching extension 28' to extension 24' as discussed above.

Figure 13:
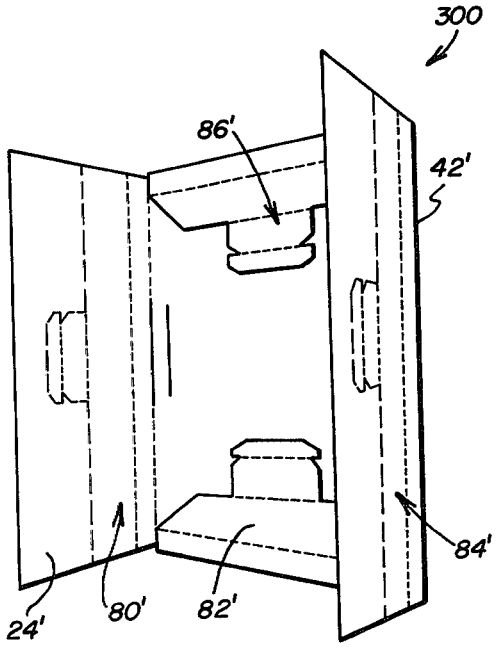
FIG. 13 illustrates a perspective view of the embodiment illustrated in FIG. 11 showing an alternative way of folding the structure of the present invention.
Figure 14:
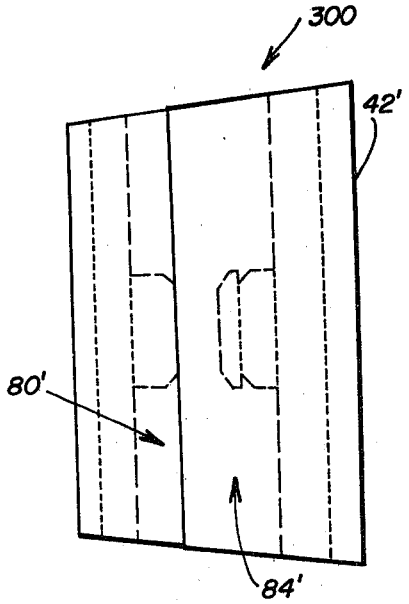
FIG. 14 illustrates a perspective view of the alternative embodiment of FIG. 13 in a further state of being folded.

An alternative manner of folding frame 300 is illustrated in FIGS. 13 and 14. In this arrangement, wall portions 82' and 86' are folded along score lines 40' and 44', respectively, to overlie base 36'. Thereafter, wall portion 80' and extension 24' are folded inwardly along score line 38' with wall portion 84' and extension 28' folded inwardly along score line 42'. The folded frame is maintained in this folded position by the attachment of either wall portion 84' or extension 28' to extension 24' from wall portion 80'. Thus, the frame is folded into its stored position illustrated in FIG. 14 without requiring attachment of any portion of the frame to the pictorial area. Further, all attachments by glue or cement may be made between extensions 28' and 24', components of the frame which are removed completely prior to assembly of the frame. Thus, damage which may occur by the use of glue or cement to attach the various components of the frame in a folded position cannot affect any portion of the frame which may be viewed upon assembly.

Upon review of the embodiment illustrated in FIGS. 11–14, it can also be seen that extensions 24' and 28' provide a ready surface for attachment of the frame in the folded position whether the frame is folded as illustrated in FIG. 12 or as illustrated in FIG. 14. Further, these extensions provide overall rigidity to the folded frame while providing additional face for instruction or promotional information.

By permitting the frame to be folded in a manner that is not likely to become unfolded during shipping or handling, the present arrangement provides a foldable frame according to the present invention which takes full advantage of space available for such frames in packages or containers. Where a frame is to be incorporated in a particular package as a promotional item or premium, the pictorial area provided by the frame is maximized where the frame may be packaged in the folded form illustrated in FIGS. 12 and 14, rather than in the completely unfolded form such as that illustrated in FIG. 1. This is the case even where the extensions illustrated with respect to the embodiments of the present invention are not incorporated. Thus, in the folded form illustrated in FIGS. 12 and 14, the space occupied by the frame is substantially equivalent to the pictorial area of the assembled frame.

For example, where the present frame is to be included within a phonograph album jacket, the pictorial size provided by the foldable frame is maximized by folding the wall portions and extensions such that they overlie the pictorial area as illustrated in FIGS. 12 and 14. A maximum pictorial size is achieved by designing the base of the foldable frame having a dimension only slightly less than the size of the album jacket and folding the wall portions and extensions thereto such that they overlie the base as illustrated in FIGS. 12 and 14. The pictorial size permitted in this folded position is substantially greater than the pictorial size which would be possible where the wall portions and extensions were in the unfolded position as illustrated in FIG. 1. The frame of the present invention is readily maintained in the folded position by use of the extensions which facilitate retaining the frame in its folded position.

While the embodiment illustrated in FIGS. 11–14 shows extensions 24' and 28' attached to wall portions 80' only one extension. For example, extension 24' can be deleted from the design illustrated in FIGS. 11–14 and extension 28' designed with sufficient size such that wall portions 82' and 86' can be attached thereto as described above with respect to the manner of folding the frame illustrated in FIGS. 11 and 12, or such that the extension may be attached to wall portion 80' where the frame of the present invention is folded in the manner illustrated in FIGS. 13 and 14. Thus, the present invention envisions the use of only a single extension from one of the wall portions to accomplish its intended result.

Thus, the present invention provides for the folding of the present frame unit such that the wall portions and extensions overlie the base of the frame. This permits a more compact finished unit which eliminates the possibility of damage to both these wall portions and extensions, as well as damage to the pictorial area during handling and prior to actual use by the consumer. Further, this arrangement permits the use of the present invention in limited size packages providing the maximum pictorial size for the frame in relation to the overall unit size.

Further, by folding the frames such that the wall portions and extensions overlie the base of the frame, larger frames, such as those which are poster size, may be more easily handled while providing a smaller unit for packaging and mailing purposes. The present invention provides a way to assure that these folded wall portions do not "spring up" away from the base in such a way that the attachment of the wall portions and extensions one to the other do not damage or deface any portion of the frame which is viewable upon assembly.

Figure 15:
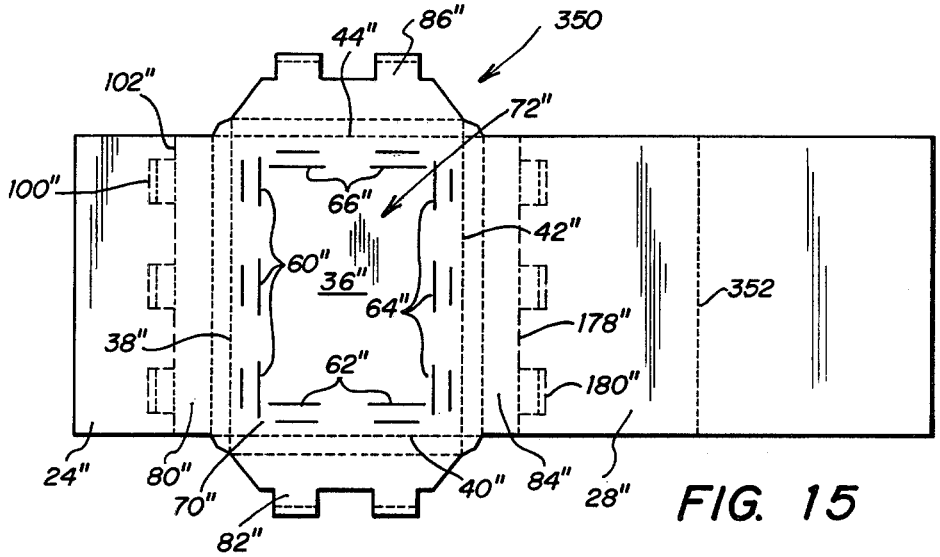
FIG. 15 illustrates a plan view of an alternative embodiment of the present invention in its unfolded configuration.
Figure 16:
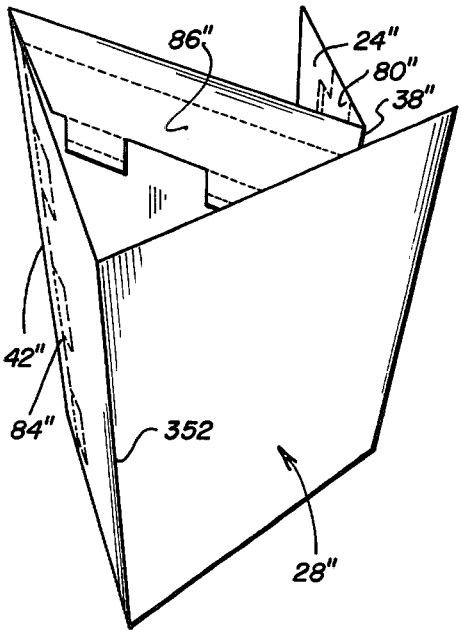
FIG. 16 illustrates a perspective view of the embodiment illustrated in FIG. 15 showing the invention partially folded.
Figure 17:
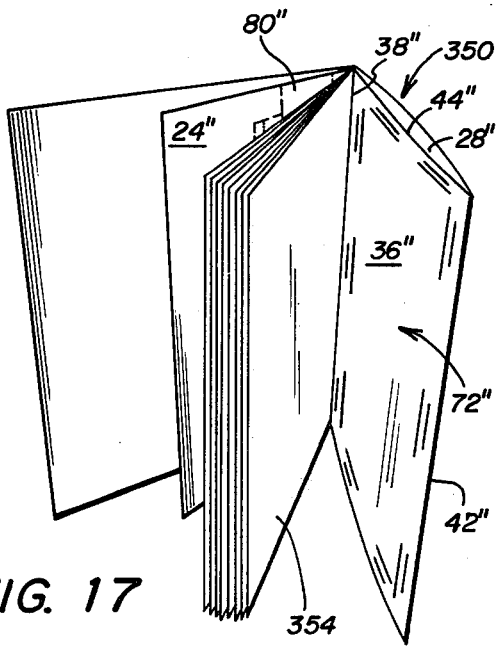
FIG. 17 illustrates a perspective view of the invention illustrated in FIG. 15 in its completed configuration wherein the invention serves as a cover for a magazine.

Another embodiment of the present invention is illustrated in FIGS. 15–17 wherein a foldable frame 350 is used to form a cover or jacket for a magazine. Because the components of frame 350 are in part identical or similar to those in the embodiments illustrated in FIGS. 1–10, corresponding or like components are designated with the same numeral as those identified with respect to frame 22 but with the addition of the designation prime prime (") added thereto.

Referring to FIGS. 15–17, frame 350 includes a base 36" with a boundary identified by score lines 38", 40", 42" and 44". Base 36" includes a border area 70" defined around the periphery thereof and between score lines 38", 40", 42" and 44" and lines drawn through slots 60", 62", 64" and 66". The remainder of base 36" provides a pictorial area 72".

Frame 350 further includes wall portions 80", 82", 84" and 86". An extension 24" is joined to wall portion 80" along perforated lines 100" and 102". Similarly, an extension 28" extends from wall portion 84" and is joined thereto along perforated lines 178" and 180". Extension 28" has a score line 352 formed substantially intermediate of the extension and parallel to fold line 42".

FIGS. 16 and 17 show the manner of folding foldable frame 350 to arrange the foldable frame to form a cover or jacket for a magazine. Referring to FIG. 16 wherein the frame is shown in a partially fold position, wall portions 86" and 82" have been folded along score lines 44" and 40", respectively, to overlie the backside of base 36". Wall portion 80" and extension 24" are folded along score line 38" to overlie base 36". Wall portion 84" and extension 28" are folded along score line 42" to overlie the backside of base 36". As can be seen in FIGS. 16 and 17, score line 352 is positioned such that it corresponds to score line 38" with extension 28" and wall portion 84" folded onto the backside of base 36".

FIG. 17 shows the frame 350 in its folded position with page 354 of a magazine attached within the folded frame along score lines 38" and 352. In its folded position, frame 350 provides for the base 36" and pictorial area 72" thereon to be positioned as the rear inside cover page of the magazine produced with frame 350 as the front and back covers. Thus, the pictorial on the frame makes up a page of the magazine while being positioned in a location where the pictorial area is not exposed but rather is protected from possible damage during shipping and handling. Although frame 350 has been described as having a pictorial area 72" on the exposed face of base 36" as viewed in FIG. 17, it will be understood that the pictorial area could also be on the reverse side of that surface making up the inside back surface of the magazine cover.

In the form illustrated in the embodiment of FIGS. 15–17, frame 350 is easily used by the consumer by merely removing page 354 from the magazine and assembling the frame as described with respect to the embodiments of FIGS. 1–10. As is discussed in greater detail hereinbefore, extensions 24" and 28" are removed from wall portions 80" and 84" prior to assembling the frame.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

I claim:

1. A product premium comprising:

a foldable frame having a multi-sided base with a wall portion extending from each side of the base, and an extension detachably secured to the end of each wall portion along the edge of the wall portion remote from the attachment of the wall portion to the base, wherein said extension and wall portion are substantially equal in dimension to the base such that each said extension and wall portion may be folded to substantially overlie the base.

2. The product premium according to claim 1 where said base is a four-sided rectangle and said extensions and wall portions form rectangles of substantially equal area to the area of the base.

3. A product premium comprising:

a foldable frame having a multi-sided base with a wall portion extending from each side of the base, an extension detachably secured to the end of each wall portion along the edge of the wall portion remote from the attachment of the wall portion to the base, and attachment means extending from the end of one of said extensions for engagement to a beverage container.

4. The product premium according to claim 3 wherein said attachment means comprises a flap attached to one of said extensions and having an aperture therethrough for engagement over one end of the beverage container.

5. A foldable frame comprising:

a four sided base with a wall portion attached along each side of the base, each wall portion adapted for folding along its line of attachment to the base such that the edge of the wall portion remote from attachment to the base may be engaged to the base to form a frame therearound, and an extension connected to each wall portion forming a rectangular section with said wall portion, said rectangular section being substantially equal in dimension to the base.

6. The frame according to claim 5 further comprising:

attachment means extending from one of said extensions for attaching said frame to a container.

7. The frame according to claim 6 wherein said attachment means comprises a flap attached to one of said extensions and having an aperture therethrough for engagement over one end of the container.

* * * * *

UNITED STATES PATENT AND TRADEMARK OFFICE

CERTIFICATE OF CORRECTION

PATENT NO. : 4,309,835
DATED : January 12, 1982
INVENTOR(S) : Don A. Naeve

It is certified that error appears in the above—identified patent and that said Letters Patent is hereby corrected as shown below:

Column 1, line 7, delete "now abandoned,".
Column 4, lines 42-43, delete "Extension 30 is connected to wall locking tab 212."
Column 6, line 11, change "to the frame" to — of the frame —.
Column 9, line 6, after " 80' ", add — and 84', the present invention also envisions the use of —;
line 66, change "fold position" to — folded position —.

Signed and Sealed this

*Eleventh* Day of *May 1982*

[SEAL]

*Attest:*

GERALD J. MOSSINGHOFF

*Attesting Officer* *Commissioner of Patents and Trademarks*